US011918932B2

(12) United States Patent
Marlor

(10) Patent No.: US 11,918,932 B2
(45) Date of Patent: Mar. 5, 2024

(54) TOY LAWNMOWER ASSEMBLY

(71) Applicant: Anthony Marlor, Mc Kwen, TN (US)

(72) Inventor: Anthony Marlor, Mc Kwen, TN (US)

( * ) Notice: Subject to any disclaimer, the term of this patent is extended or adjusted under 35 U.S.C. 154(b) by 171 days.

(21) Appl. No.: 17/573,002

(22) Filed: Jan. 11, 2022

(65) Prior Publication Data

US 2023/0219012 A1 Jul. 13, 2023

(51) Int. Cl.
*A63H 33/30* (2006.01)
*A63H 7/02* (2006.01)

(52) U.S. Cl.
CPC ..... *A63H 33/30* (2013.01); *A63H 7/02* (2013.01)

(58) Field of Classification Search
CPC ..... A63H 7/02; A63H 17/34; A63H 33/30; A01D 34/08
USPC ..... 56/201, 255–256, 14.8
See application file for complete search history.

(56) References Cited

U.S. PATENT DOCUMENTS 158,794 A * 1/1875 Hand ..... A01D 34/67 56/255
207,066 A * 8/1878 Rau ..... A01D 34/77 56/255
262,593 A * 8/1882 Hobbs ..... A01D 34/77 56/255
296,759 A * 4/1884 Lacasse ..... A01D 34/08 56/5
498,533 A * 5/1893 Clousing ..... 56/255
578,666 A * 3/1897 Thornburg ..... 56/255
623,040 A * 4/1899 Sather ..... A01D 34/08 56/201
697,415 A * 4/1902 Spates ..... 56/255
784,396 A * 3/1905 Hall ..... 56/DIG. 18
887,592 A * 5/1908 Crepar et al. ..... A01D 42/02 56/246
1,189,519 A * 7/1916 Word ..... 56/DIG. 18
1,208,741 A * 12/1916 Brown ..... A01G 3/06 56/256
1,336,257 A * 4/1920 Muzzy ..... A01D 34/63 56/250
1,868,918 A * 7/1932 Schenk ..... A01D 34/78 56/DIG. 8
1,977,457 A * 10/1934 Smith ..... A63H 33/30 446/144
2,132,465 A * 10/1938 Gast ..... A01G 3/06 15/79.1
2,150,085 A * 3/1939 Todd ..... A01D 34/62 56/294

(Continued)

FOREIGN PATENT DOCUMENTS

GB 2109255 6/1983

*Primary Examiner* — Eugene L Kim
*Assistant Examiner* — Matthew B Stanczak

(57) ABSTRACT

A toy lawnmower assembly includes a housing that has a variety of structural features molded into the housing such that the housing has the ornamental appearance of a push type lawn mower. A plurality of wheels is rotatably coupled to the housing for rolling along a support surface. A drive unit is movably integrated into the housing and the drive unit is in mechanical communication with at least one of the wheels. The drive unit is rotated when the at least one wheel is rotated. A trimming unit is coupled to the drive unit and the trimming unit is rotated when the drive unit is rotated. Furthermore, the trimming unit is directed downwardly on the housing to trim the lawn when the housing is pushed along the lawn.

5 Claims, 6 Drawing Sheets

(56) References Cited

U.S. PATENT DOCUMENTS 2,288,498 A * 6/1942 Underwood ..... A01D 34/08 56/17.6
2,504,268 A * 4/1950 Lee ..... A01D 34/66 56/255
2,539,779 A * 1/1951 Grosso ..... A01D 34/63 15/337
2,603,931 A * 7/1952 Pivert ..... A01D 43/16 56/2
2,734,327 A * 2/1956 Whitney ..... A01D 43/063 56/201
2,781,609 A * 2/1957 Allen ..... A63H 33/30 446/144
2,960,791 A * 11/1960 Reed ..... A63H 33/3088 446/144
3,074,221 A * 1/1963 Martins ..... A01D 34/08 56/17.6
3,292,300 A * 12/1966 Lescher ..... A01D 34/63 74/25
3,983,662 A * 10/1976 Hart ..... A63H 33/30 446/144
4,048,791 A * 9/1977 Treen ..... A01D 34/84 56/246
4,295,294 A * 10/1981 Rosenwinkel ..... A63H 33/32 446/144
RE32,973 E * 7/1989 Panzarella ..... A63H 33/28 446/16
5,041,043 A 8/1991 Hoke
5,274,987 A * 1/1994 Wiener ..... A01D 34/73 56/14.8
5,706,637 A * 1/1998 Hamilton ..... A01D 34/77 56/14.8
6,408,967 B1 6/2002 Huntsberger
6,701,700 B2 * 3/2004 Keane ..... A01D 43/16 56/DIG. 17
7,806,747 B2 10/2010 Duncan
10,265,637 B2 * 4/2019 Bernbaum ..... B62B 7/12
2022/0266162 A1 * 8/2022 Hancock ..... A63H 33/007
2023/0082490 A1 * 3/2023 Moon ..... A63H 33/3072 446/144
2023/0219012 A1 * 7/2023 Marlor ..... A63H 7/02 446/144

* cited by examiner

TOY LAWNMOWER ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to lawnmower devices and more particularly pertains to a new lawnmower device for facilitating a child to practice employing a lawnmower. The device includes a housing which is structured to resemble a push lawnmower, plurality of wheels rotatably disposed on the housing and a drive unit integrated into the housing. The drive unit is rotated when the wheel rotate. The device includes a trimming unit that is coupled to the drive unit such that the trimming unit is rotated when the drive unit rotates. In this way the trimming unit can trim grass when the housing is being pushed.

(2) Description of Related Art Including Information Disclosed Under 37 CFR 1.97 and 1.98

The prior art relates to lawnmower devices including a toy lawn mower that has a translucent motor and a pair visible reciprocating pistons. The prior art discloses a toy lawnmower that has an agitator and a collection bin for collecting debris that is agitated by the agitator. The prior art discloses a toy lawn mower that has an animated figure that is in mechanical communication with a wheel on the toy lawn mower.

(h) BRIEF SUMMARY OF THE INVENTION

An embodiment of the disclosure meets the needs presented above by generally comprising a housing that has a variety of structural features molded into the housing such that the housing has the ornamental appearance of a push type lawn mower. A plurality of wheels is rotatably coupled to the housing for rolling along a support surface. A drive unit is movably integrated into the housing and the drive unit is in mechanical communication with at least one of the wheels. The drive unit is rotated when the at least one wheel is rotated. A trimming unit is coupled to the drive unit and the trimming unit is rotated when the drive unit is rotated. Furthermore, the trimming unit is directed downwardly on the housing to trim the lawn when the housing is pushed along the lawn.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
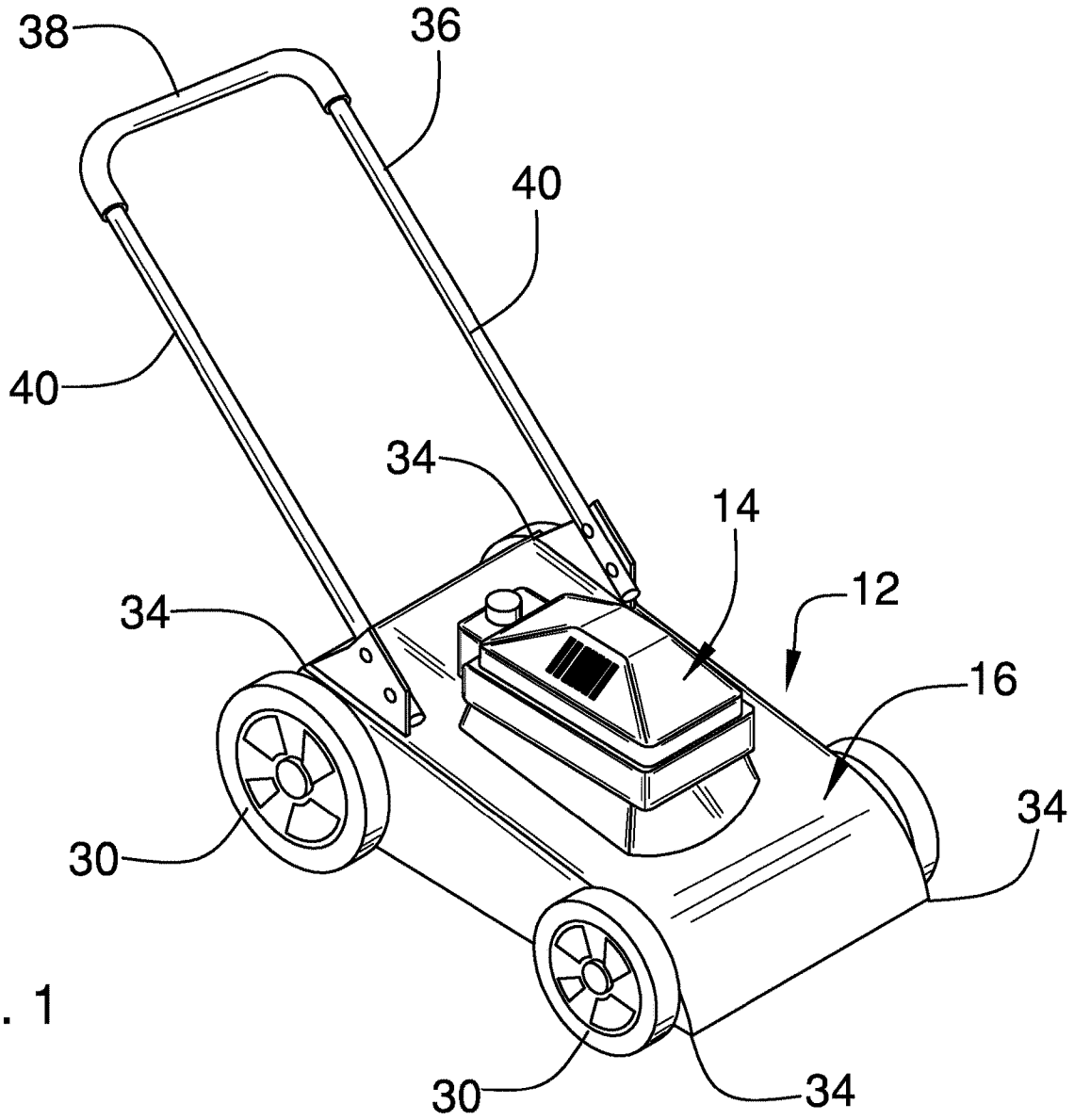
FIG. 1 is a top perspective view of a toy lawnmower assembly according to an embodiment of the disclosure.
Figure 2:
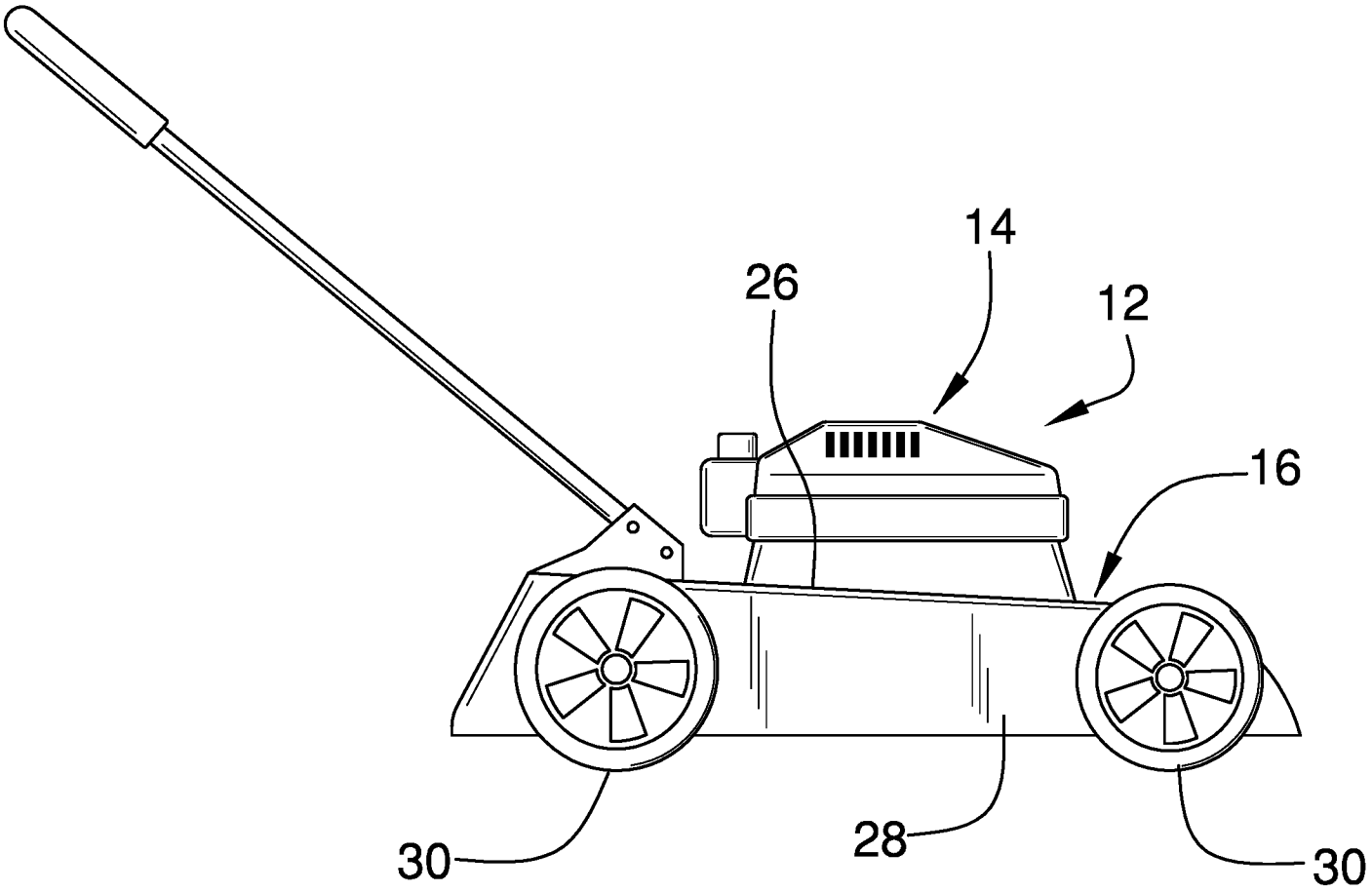
FIG. 2 is a right side view of an embodiment of the disclosure.
Figure 3:
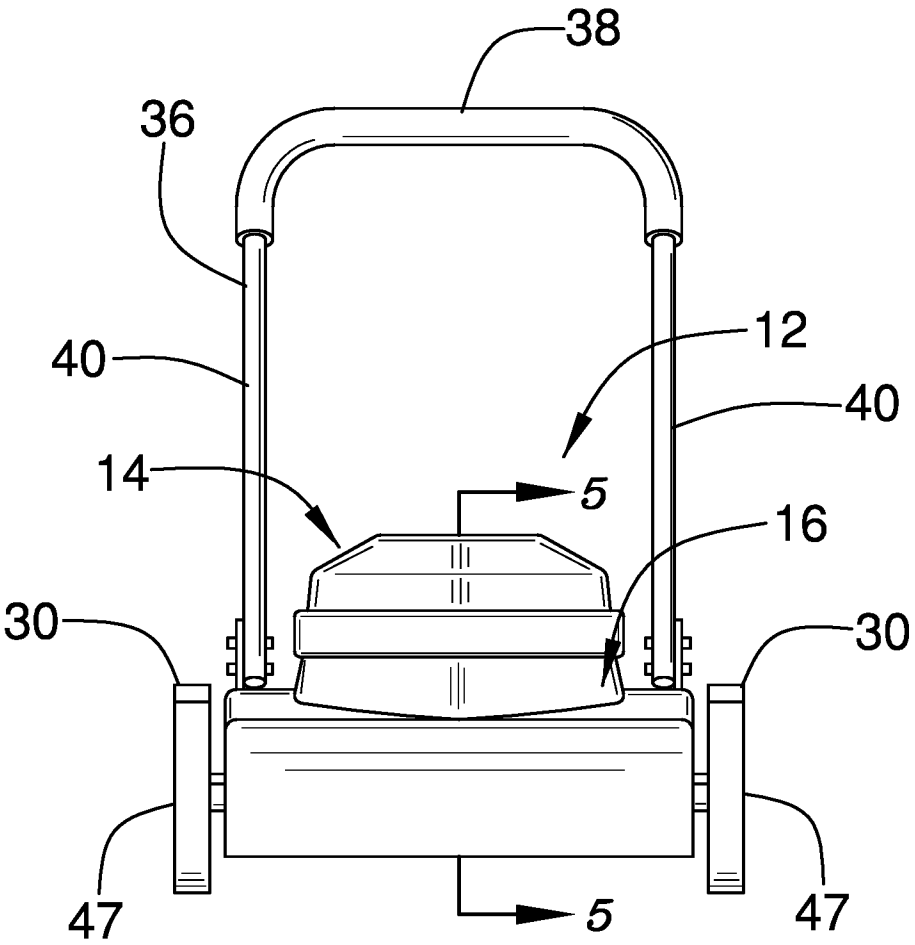
FIG. 3 is a back view of an embodiment of the disclosure.
Figure 4:
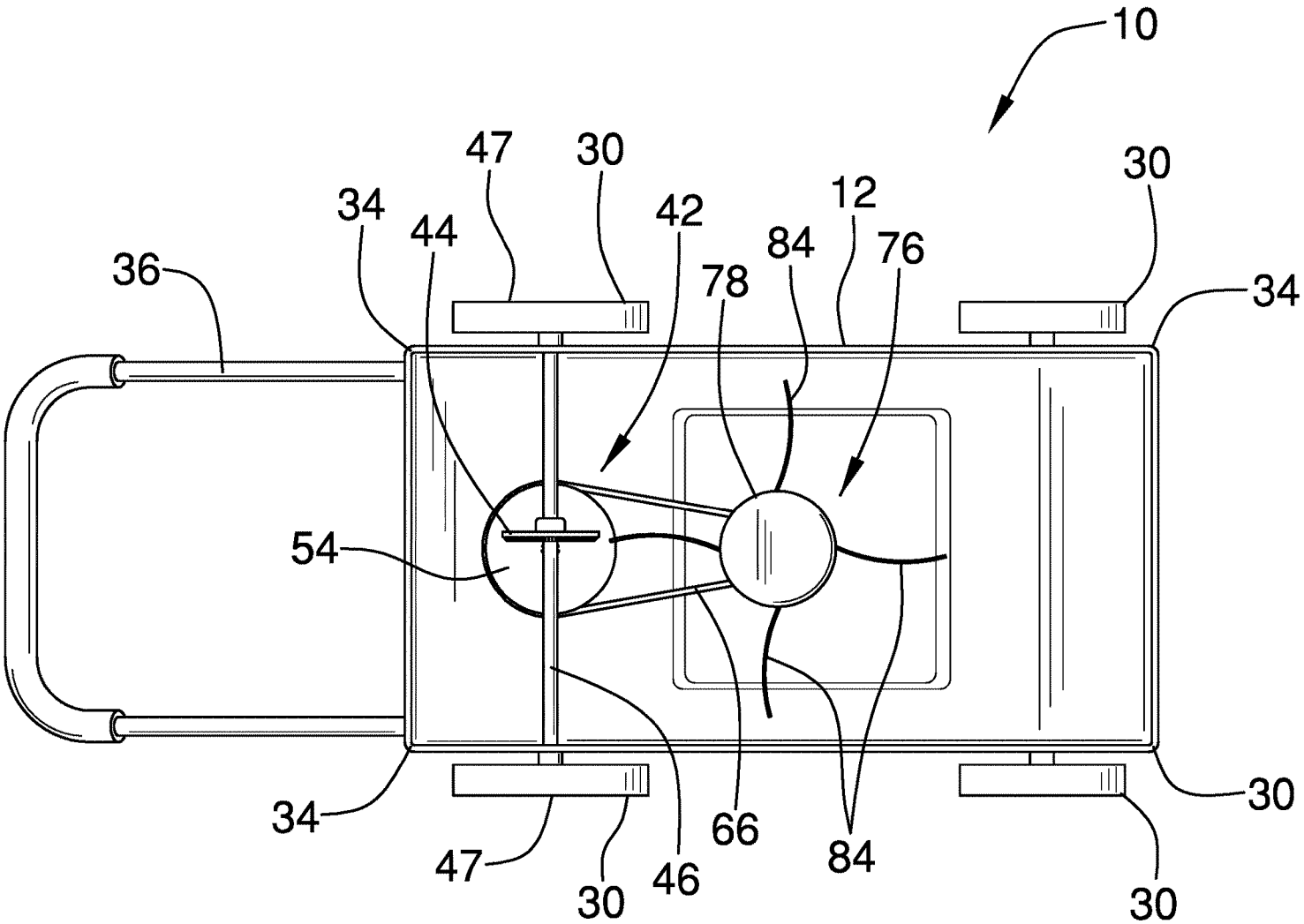
FIG. 4 is a bottom view of an embodiment of the disclosure.
Figure 5:
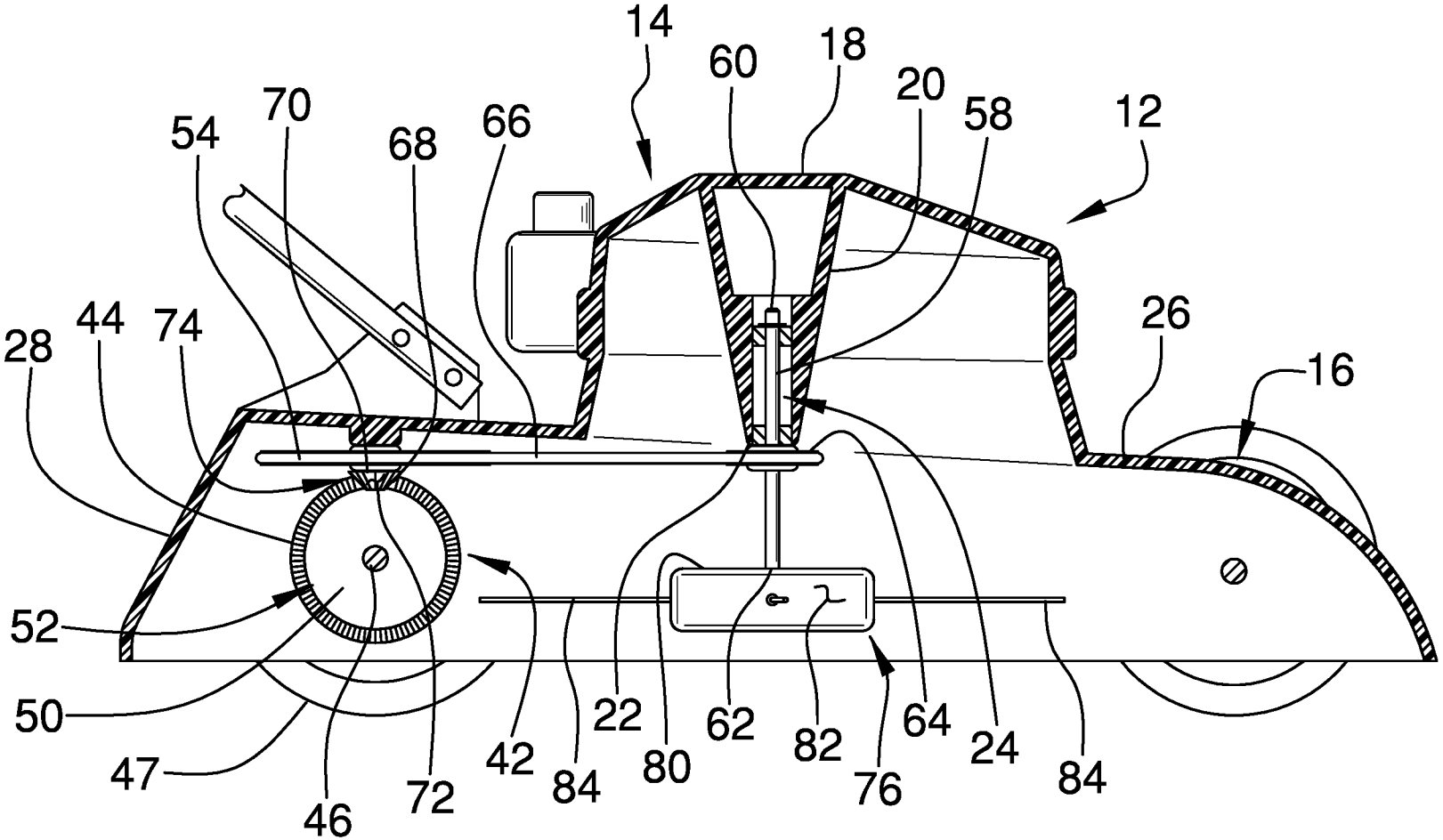
FIG. 5 is a cross sectional view taken along line 5-5 of FIG. 3 of an embodiment of the disclosure.
Figure 6:
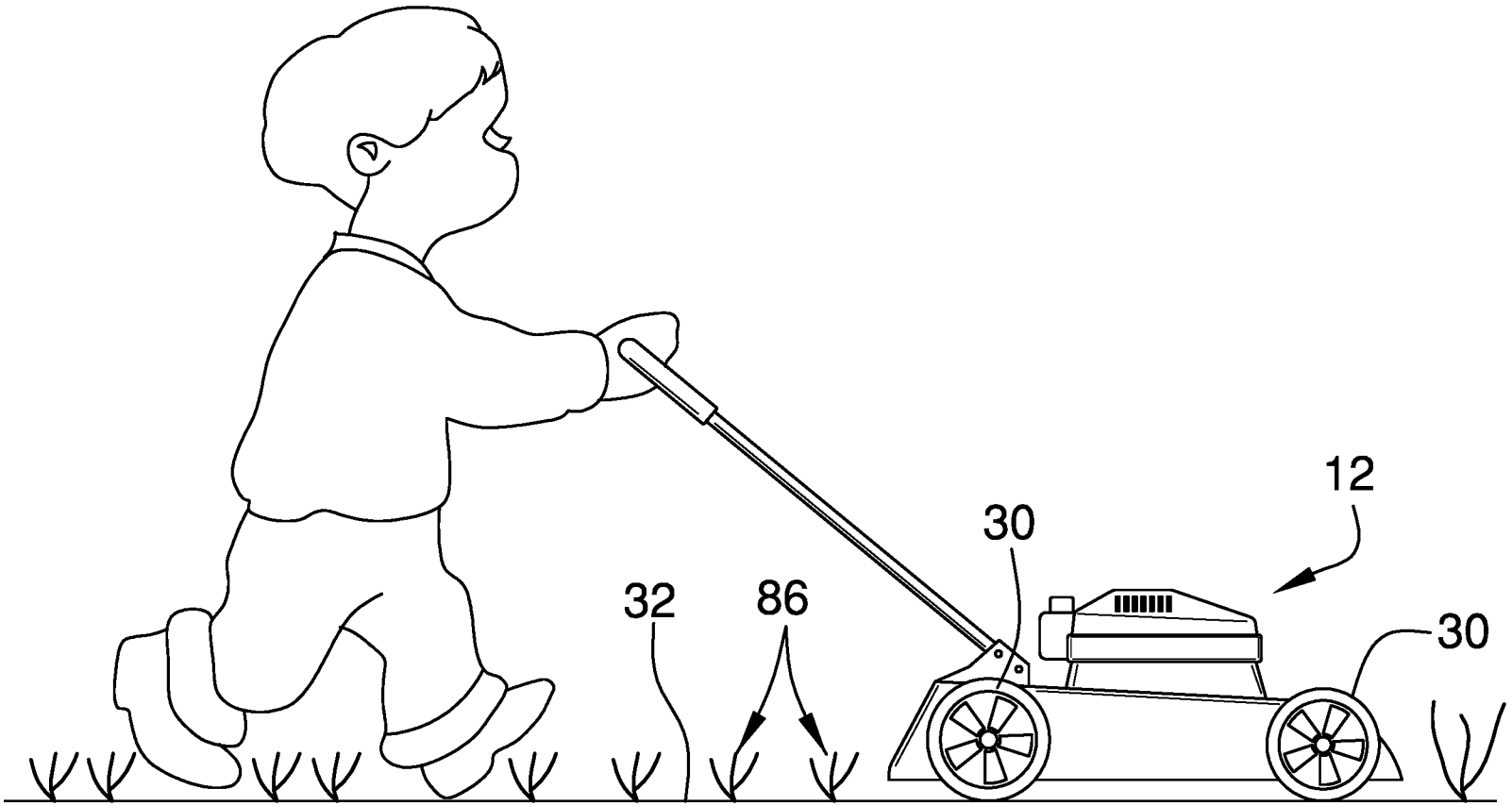
FIG. 6 is a perspective in-use view of an embodiment of the disclosure.

With reference now to the drawings, and in particular to FIGS. 1 through 6 thereof, a new lawnmower device embodying the principles and concepts of an embodiment of the disclosure and generally designated by the reference numeral 10 will be described.

As best illustrated in FIGS. 1 through 6, the toy lawnmower assembly 10 generally comprises a housing 12 which has a variety of structural features molded into the housing 12 to define a motor portion 14 of the housing 12 extending upwardly from a deck portion 16 of the housing 12. In this way the housing 12 has the ornamental appearance of a push type lawn mower. The motor portion 14 has a top wall 18 and the housing 12 has a shaft receiver 20 extending downwardly from the top wall 18 of the motor portion 14. The shaft receiver 20 has a distal end 22 with respect to the top wall 18 and the distal end 22 has a shaft well 24 extending toward the top wall 18. Additionally, the deck portion 16 has an upper wall 26 and a perimeter wall 28.

A plurality of wheels 30 is each rotatably coupled to the housing 12 thereby facilitating the housing 12 to be rolled along a support surface 32. Each of the wheels 30 is positioned on the perimeter wall 28 of the deck portion 16 of the housing 12, and each of the wheels 30 is aligned with a respective one of four corners 34 of the perimeter wall 28.

A handle 36 is pivotally coupled to and angles upwardly from the housing 12. The handle 36 can be gripped by a child such that the child can push the housing 12 in the convention of a lawn mower. The handle 36 has a central portion 38 which is perpendicularly oriented between a pair of outward portions 40. Each of the outward portions 40 has a distal end 22 with respect to the central portion 38 and each of the outward portions 40 is pivotally engaged to a respective engagement point on the upper wall 26 of the deck portion 16 of the housing 12 at a point located adjacent to the distal end 22 of the outward portions 40.

A drive unit 42 is movably integrated into the housing 12 and the drive unit 42 is in mechanical communication with at least one of the wheels 30. The drive unit 42 is rotated when the at least one wheel is rotated. The drive unit 42 comprises a primary gear 44 that is positioned around an axle 46 extending between a rear pair of the wheels 47. In this way the primary gear 44 rotates about a rotational axis of the axle 46 when the rear pair of wheels 48 rotates. The primary gear 44 has a front face 50 and the front face 50 has a plurality of teeth 52 extending away from the front face 50. Moreover, the teeth 52 are spaced apart from each other and are distributed around a perimeter of the front face such that the teeth 52 encircle the rotational axis of the axle 46.

The drive unit 42 includes a first pulley 54 that is rotatably disposed on a bottom side 56 of the upper wall 26 of the deck portion 16 of the housing 12. The drive unit 42 includes a shaft 58 that has an upper end 60 and a lower end 62, and the shaft 58 is rotatably disposed in the shaft well 24 in the distal end 22 of the shaft receiver 20. Additionally, the upper end 60 is positioned within the shaft well 24 and the lower end 62 is spaced downwardly from the distal end 22 of the shaft receiver 20. The drive unit 42 includes a second pulley 64 that is positioned around the shaft 58 such that the second pulley 64 rotates the shaft 58 about an axis extending through the upper end 60 and the lower end 62. The drive unit 42 includes a belt 66 extending around the first pulley 54 and the second pulley 64 such that the second pulley 64 is rotated when the first pulley 54 rotates.

The drive unit 42 includes a secondary gear 68 that has an upper surface 70 and an outer surface 72, and the upper surface 70 is coupled to the second pulley 64. The outer surface 72 tapers inwardly from the upper surface 70, and a plurality of teeth 74 is integrated into the outer surface 72 and is distributed around the outer surface 72. The plurality of teeth 74 on the outer surface 72 engages the plurality of teeth 52 on the front face 50 of the primary gear 44 such that the secondary gear 68 rotates the second pulley 64 when the primary gear 44 rotates. The primary gear 44 has a greater number of teeth than does the secondary gear 68 such that the rotational speed of the secondary gear 68 is increased with respect to the rotational speed of the primary gear 44. Additionally, the first pulley 54 has a diameter that is greater than the diameter of the second pulley 64. In this way the rotational speed of the second pulley 64 is significantly increased beyond the rotational speed of the pair of rear wheels 47.

A trimming unit 76 is coupled to the drive unit 42 and the trimming unit 76 is rotated when the drive unit 42 is rotated. The trimming unit 76 is directed downwardly on the housing 12 thereby facilitating the trimming unit 76 to trim the lawn when the housing 12 is pushed along the lawn. The trimming unit 76 comprises a trimming head 78 that has a top surface 80 and a perimeter surface 82. The top surface 80 is coupled to the lower end 62 of the shaft 58 such that the trimming head 78 is rotated when the shaft 58 rotates, and the shaft 58 is centrally positioned on the top surface 80. The trimming unit 76 includes a plurality of filaments 84 that is each coupled to and extends away from the perimeter surface 82 of the trimming head 78. In this way each of the filaments 84 can strike grass 86 growing in the lawn when the trimming head 78 is rotated thereby trimming the grass 86.

In use, the handle 36 is gripped to push the housing 12 along the lawn. The rear wheels 30 drive the drive unit 42 to rotate the trimming unit 76. In this way the filaments 84 on the trimming head 78 are rapidly rotated to trim grass 86 growing in the lawn. Thus, a child can practice employing a powered lawnmower without the risk of being injured while still actually trimming the grass 86. Moreover, the trimming unit 76 is motionless when the rear wheels 30 are not rotating, thereby facilitating the trimming unit 76 to be harmless.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toy lawnmower assembly for facilitating a child to safely trim a lawn, said assembly comprising:

a housing having structural features being molded into said housing to define a motor portion of said housing extending upwardly from a deck portion of said housing wherein said housing is configured to have the ornamental appearance of a push type lawn mower, said motor portion having a shaft receiver being integrated into said motor portion, said deck portion having an upper wall;

a plurality of wheels, each of said wheels being rotatably coupled to said housing thereby facilitating said housing to be rolled along a support surface;

a handle being coupled to and angling upwardly from said housing wherein said handle is configured to be gripped by a child such that the child can push said housing in the convention of a lawn mower;

a drive unit being movably integrated into said housing, said drive unit being in mechanical communication with at least one of said wheels, said drive unit being rotated when said at least one wheel is rotated;

a trimming unit being coupled to said drive unit, said trimming unit being rotated when said drive unit is rotated, said trimming unit being directed downwardly on said housing wherein said trimming unit is configured to trim the lawn when said housing is pushed along the lawn; and wherein said drive unit comprises:

a primary gear being positioned around an axle extending between a rear pair of said wheels such that said primary gear rotates about a rotational axis of said axle when said rear pair of wheels rotates, said primary gear having a front face, said front face having a plurality of teeth extending away from said front face, said teeth being spaced apart from each other and being distributed around a perimeter of said front face such that said teeth encircle said rotational axis of said axle;

a secondary gear having an upper surface and an outer surface, said outer surface tapering inwardly from said upper surface, said outer surface having a plurality of teeth being integrated into said outer surface and being distributed around said outer surface, said plurality of teeth on said outer surface engaging said plurality of teeth on said front face of said primary gear;

a first pulley being rotatably disposed on a bottom side of said upper wall of said deck portion of said housing, said secondary gear rotating said first pulley when said primary gear rotates;

a shaft having an upper end and a lower end, said shaft being rotatably disposed in said shaft well in said distal end of said shaft receiver, said upper end being positioned within said shaft well, said lower end being spaced downwardly from said distal end of said shaft receiver;

a second pulley being positioned directly around said shaft such that said second pulley rotates said shaft about an axis extending through said upper end and said lower end, said upper surface of said secondary gear being coupled to said first pulley; and said trimmer unit comprises a trimming head having a top surface and a perimeter surface, said top surface being directly coupled to said shaft wherein said trimming head is rotated by said shaft.

2. The assembly according to claim 1, wherein:

said motor portion has a top wall;

said housing has a shaft receiver extending downwardly from said top wall of said motor portion, said shaft receiver having a distal end with respect to said top wall, said distal end having a shaft well extending toward said top wall;

said deck portion has an upper wall and a perimeter wall;

each of said wheels is positioned on said perimeter wall of said deck portion of said housing, each of said wheels being aligned with a respective one of four corners of said perimeter wall; and said handle has a central portion being perpendicularly oriented between a pair of outward portions, each of said outward portions having a distal end with respect to said central portion, each of said outward portions being pivotally engaged to a respective engagement point on said upper wall of said deck portion of said housing at a point located adjacent to said distal end of said outward portions.

3. The assembly according to claim 1, wherein said shaft is centrally positioned on said top surface.

4. The assembly according to claim 3, wherein said trimmer unit includes a plurality of filaments, each of said filaments being coupled to and extending away from said perimeter surface of said trimming head wherein each of said filaments is configured to strike grass growing in the lawn when said trimming head is rotated thereby trimming the grass.

5. A toy lawnmower assembly for facilitating a child to safely trim a lawn, said assembly comprising:

a housing having structural features being molded into said housing to define a motor portion of said housing extending upwardly from a deck portion of said housing wherein said housing is configured to have the ornamental appearance of a push type lawn mower, said motor portion having a top wall, said housing having a shaft receiver extending downwardly from said top wall of said motor portion, said shaft receiver having a distal end with respect to said top wall, said distal end having a shaft well extending toward said top wall, said deck portion having an upper wall and a perimeter wall;

a plurality of wheels, each of said wheels being rotatably coupled to said housing thereby facilitating said housing to be rolled along a support surface, each of said wheels being positioned on said perimeter wall of said deck portion of said housing, each of said wheels being aligned with a respective one of four corners of said perimeter wall;

a handle being coupled to and angling upwardly from said housing wherein said handle is configured to be gripped by a child such that the child can push said housing in the convention of a lawn mower, said handle having a central portion being perpendicularly oriented between a pair of outward portions, each of said outward portions having a distal end with respect to said central portion, each of said outward portions being engaged to a respective engagement point on said upper wall of said deck portion of said housing at a point located adjacent to said distal end of said outward portions;

a drive unit being movably integrated into said housing, said drive unit being in mechanical communication with at least one of said wheels, said drive unit being rotated when said at least one wheel is rotated, said drive unit comprising:

a primary gear being positioned around an axle extending between a rear pair of said wheels such that said primary gear rotates about a rotational axis of said axle when said rear pair of wheels rotates, said primary gear having a front face, said front face having a plurality of teeth extending away from said front face, said teeth being spaced apart from each other and being distributed around a perimeter of said front face such that said teeth encircle said rotational axis of said axle;

a first pulley being rotatably disposed on a bottom side of said upper wall of said deck portion of said housing;

a shaft having an upper end and a lower end, said shaft being rotatably disposed in said shaft well in said distal end of said shaft receiver, said upper end being positioned within said shaft well, said lower end being spaced downwardly from said distal end of said shaft receiver;

a second pulley being positioned directly around said shaft such that said second pulley rotates said shaft about an axis extending through said upper end and said lower end;

a belt extending around said first pulley and said second pulley such that said second pulley is rotated when said first pulley rotates; and a secondary gear having an upper surface and an outer surface, said upper surface being coupled to said first pulley, said outer surface tapering inwardly from said upper surface, said outer surface having a plurality of teeth being integrated into said outer surface and being distributed around said outer surface, said plurality of teeth on said outer surface engaging said plurality of teeth on said front face of said primary gear such that said secondary gear rotates said first pulley when said primary gear rotates; and a trimming unit being coupled to said drive unit, said trimming unit being rotated when said drive unit is rotated, said trimming unit being directed downwardly on said housing wherein said trimming unit is configured to trim the lawn when said housing is pushed along the lawn, said trimmer unit comprising:

a trimming head having a top surface and a perimeter surface, said top surface being coupled directly to said lower end of said shaft such that said trimming head is rotated when said shaft rotates, said shaft being centrally positioned on said top surface; and a plurality of filaments, each of said filaments being coupled to and extending away from said perimeter surface of said trimming head wherein each of said filaments is configured to strike grass growing in the lawn when said trimming head is rotated thereby trimming the grass.

* * * * *